US008646680B2

(12) United States Patent
Low et al.

(10) Patent No.: US 8,646,680 B2
(45) Date of Patent: Feb. 11, 2014

(54) SHEET AND FOLDING METHOD FOR SELF-LATCHING CLAMSHELL FOLDED BOX

(71) Applicant: OIA Global Logistics SCM, Inc., Portland, OR (US)

(72) Inventors: Anna Low, Portland, OR (US); Richard Shih-Ning Fan, Portland, OR (US)

(73) Assignee: OIA Global Logistics SCM, Inc., Portland, OR (US)

( * ) Notice: Subject to any disclaimer, the term of this patent is extended or adjusted under 35 U.S.C. 154(b) by 0 days.

(21) Appl. No.: 13/747,107

(22) Filed: Jan. 22, 2013

(65) Prior Publication Data

US 2013/0193197 A1 Aug. 1, 2013

Related U.S. Application Data

(60) Provisional application No. 61/592,464, filed on Jan. 30, 2012.

(51) Int. Cl.
*B65D 5/22* (2006.01)
*B65D 5/68* (2006.01)

(52) U.S. Cl.
USPC ..... 229/145; 229/148; 229/178; 229/179

(58) Field of Classification Search
USPC ..... 229/145, 146, 148, 178, 179
See application file for complete search history.

(56) References Cited

U.S. PATENT DOCUMENTS

| | | | | | |
|---|---|---|---|---|---|
| 2,531,507 | A * | 11/1950 | Goodyear | 229/145 |
| 2,551,324 | A * | 5/1951 | Frieders et al. | 229/145 |
| 2,623,684 | A * | 12/1952 | Collura | 229/146 |
| 2,957,617 | A * | 10/1960 | Bolding | 229/149 |
| 2,982,465 | A * | 5/1961 | Fallert | 229/148 |
| 3,684,159 | A * | 8/1972 | Wolfe | 229/145 |
| 3,942,712 | A * | 3/1976 | Bundy et al. | 229/149 |
| 4,048,052 | A * | 9/1977 | Tolaas | 229/145 |
| 4,391,405 | A * | 7/1983 | Drinon | 229/145 |
| 4,877,178 | A * | 10/1989 | Eisman | 229/148 |
| 4,951,865 | A * | 8/1990 | Eisman | 229/146 |
| 5,058,803 | A * | 10/1991 | Gulliver | 229/148 |
| 5,538,179 | A * | 7/1996 | Cai | 229/146 |
| 5,788,145 | A * | 8/1998 | Grahahm et al. | 229/146 |
| 5,921,466 | A * | 7/1999 | Speese et al. | 229/178 |
| 6,685,085 | B2 * | 2/2004 | Hanna | 229/148 |
| 2003/0222130 | A1 * | 12/2003 | Fukushima et al. | 229/145 |
| 2004/0124236 | A1 * | 7/2004 | Howard | 229/145 |
| 2006/0219768 | A1 * | 10/2006 | Philips | 229/179 |

* cited by examiner

*Primary Examiner* — Gary Elkins
(74) *Attorney, Agent, or Firm* — K&L Gates LLP

(57) ABSTRACT

Suitably configured sheets of material and related folding methods provide self-latching clamshell folded boxes that may be used, for example, to securely package consumer goods such as shoes or other clothing items.

14 Claims, 16 Drawing Sheets

SHEET AND FOLDING METHOD FOR SELF-LATCHING CLAMSHELL FOLDED BOX

CROSS REFERENCE TO RELATED APPLICATIONS

This application claims priority to U.S. Provisional Patent Application No. 61/529,464 filed Jan. 30, 2012 and titled "Sheet and Folding Method For Self-Latching Clamshell Folded Box", which is incorporated by reference herein in its entirety.

FIELD OF THE INVENTION

The invention relates generally to self-latching containers for packaging, e.g., consumer goods.

BACKGROUND

Consumer goods of various sorts such as shoes or other clothing items, for example, may be packaged for shipping, storage, and sales in lidded containers. During such shipment, storage, or sales, such containers may be inadvertently up-ended, with the possibility that the container lid may open and the consumer good may spill from the container.

SUMMARY

Suitably configured sheets of material and related folding methods provide self-latching clamshell folded boxes that may be used, for example, to securely package consumer goods such as shoes or other clothing items.

In one aspect, a sheet of material is configured to be folded into a self-latching clamshell box. The sheet of material comprises a tray section comprising fold lines defining a rectangular tray bottom panel, first and second tray side panels attached to and on opposite ends of the tray bottom panel, a tray front panel attached to a front end of the tray bottom panel, a tray back panel attached to a back end of the tray bottom panel opposite from the front end of the tray bottom panel, a first latching tab attached to an outer front corner of the first tray side panel, and a second latching tab attached to an outer front corner of the second tray side panel.

The sheet of material also comprises a lid section comprising fold lines defining a rectangular lid top panel, a lid front panel attached to the lid top panel opposite from the tray back panel, and a lid front roll-over panel attached to the lid front panel. The lid front roll-over panel comprises notches in two outer corners. A back end of the lid top panel is defined by a fold line between the lid top panel and the tray back panel.

The tray section fold lines are configured such that the first and second tray side panels, the tray front panel, and the tray back panel may each be folded about 90 degrees with respect to the tray bottom panel about respective fold lines to form, respectively, first and second tray side walls, a tray front wall, and a tray back wall of a tray portion of the clamshell box. The first and second latching tabs may be folded about 180 degrees with respect to the first and second tray side panels, respectively, about respective fold lines to form first and second protrusions extending outward from the tray front wall (e.g., away from the tray back wall) at opposite ends of the tray front wall. The lid section fold lines are configured such that the lid front roll-over panel may be folded about 180 degrees with respect to the lid front panel about a respective fold line, and the lid front panel and the lid front roll-over panel may be folded about 90 degrees with respect to the lid top panel about a respective fold line to form a lid front wall of a lid portion of the clamshell box. The lid front wall then comprises inner recesses formed by the notches in the lid front roll-over panel. The fold line between the tray back panel and the lid top panel is configured to form a clamshell hinge about which the folded lid portion may be rotated to close the clamshell box, with the protrusions on the tray front wall of the folded tray portion engaging the inner recesses in the lid front wall of the lid portion to latch the lid portion to the tray portion.

In another aspect, a sheet of material is folded by a method as summarized above to form a self-latching clamshell box.

In the self-latching clamshell boxes of the above aspects, the latching mechanism formed by the protrusions in the tray front wall and the recesses in the lid front wall may latch the box sufficiently securely that an upside-down empty box remains closed even after having been previously opened about five times, for example.

The self-latching clamshell boxes of the above aspects may be dimensioned and configured, for example, to contain shoes.

These and other embodiments, features and advantages of the present invention will become more apparent to those skilled in the art when taken with reference to the following more detailed description of the invention in conjunction with the accompanying drawings that are first briefly described.

DETAILED DESCRIPTION

The following detailed description should be read with reference to the drawings, in which identical reference numbers refer to like elements throughout the different figures. The drawings, which are not necessarily to scale, depict selective embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention.

This specification describes sheets of material configured to be folded along fold lines into self-latching clamshell boxes, and related folding methods. As used in this specification and the claims, the term "fold line" refers to a line in a sheet of material about which the sheet of material has been predisposed to fold. Such predisposition may be induced, for example, by slitting, scoring, or creasing the sheet of material along the fold line, or by any other suitable method. Fold lines are depicted in the figures by thick or bold lines to distinguish them from thinner lines defining the edges of the sheets or defining cut lines in the sheets. Also as used in this specification and the appended claims, the singular forms "a," "an," and "the" include plural referents unless the context clearly indicates otherwise.

Figure 1A:
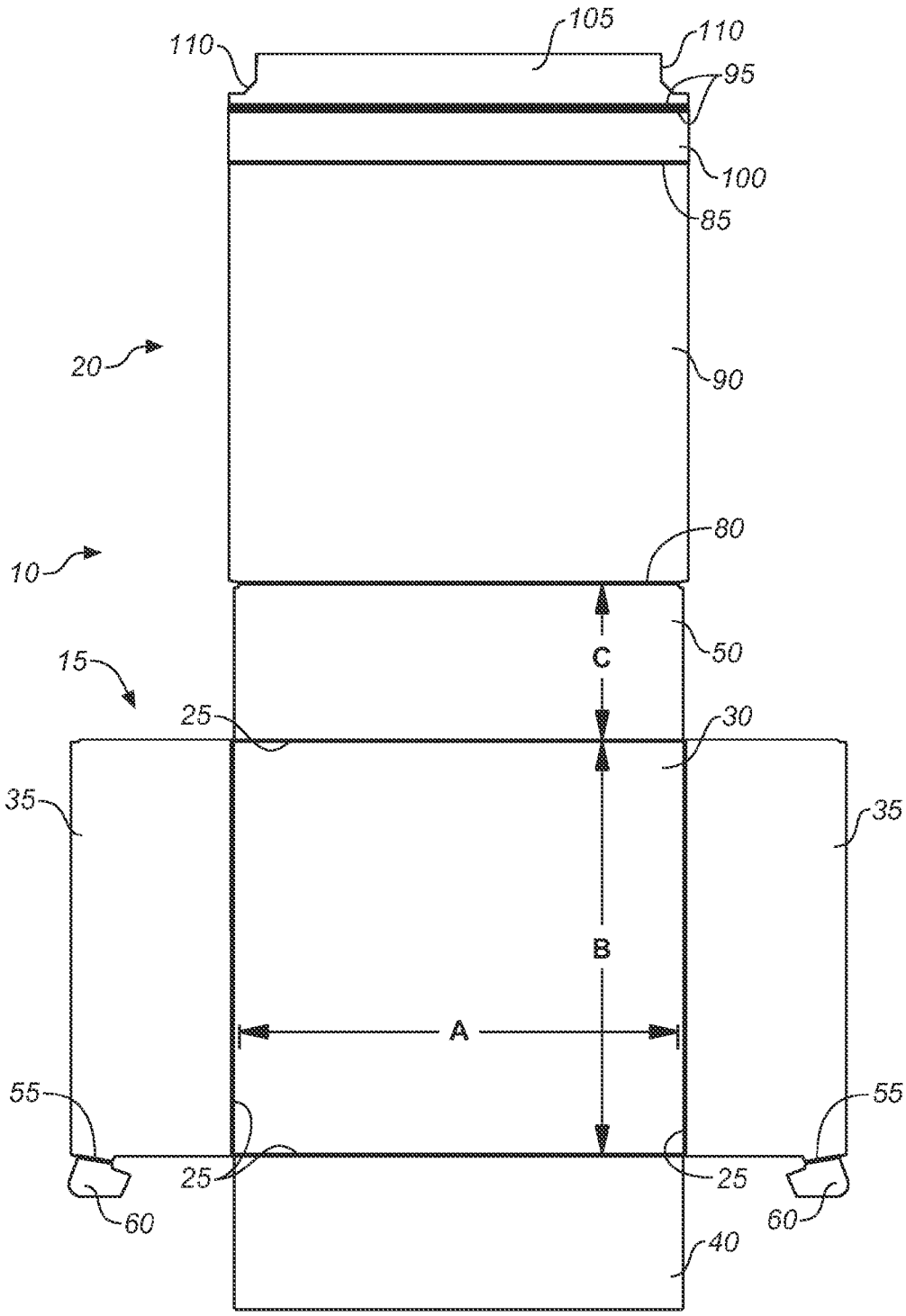
FIGS. 1A-1C show, respectively, a schematic drawing of an example sheet of material configured for folding into a self-latching clamshell box (FIG. 1A), a schematic diagram of the same sheet of material partially folded to provide latching protrusions on a tray portion and complementary recesses on a lid portion (FIG. 1B), and a perspective view of a corner of the clamshell box showing an example latching protrusion (FIG. 1C).

Referring now to FIG. 1A, an example sheet of material 10 configured for folding into a self-latching clamshell box comprises a tray section 15 and a lid section 20. Tray section 15 comprises fold lines 25 defining tray bottom panel 30, tray side panels 35, tray front panel 40, and tray back panel 50. Side panels 35, front panel 40, and back panel 50 may be folded by about 90 degrees around their respective fold lines and secured to each other in any suitable manner to form corresponding walls of a tray portion of the clamshell box. The panels may be secured to each other, for example, with tape, adhesive, or any suitable fastener. Alternatively, or in addition, the panels may be secured to each other using folding and tab and slot methods as described further below (FIGS. 2 and 3A-3L), for example, in which case sheet 10 may comprise additional panels and features.

Figure 1B:
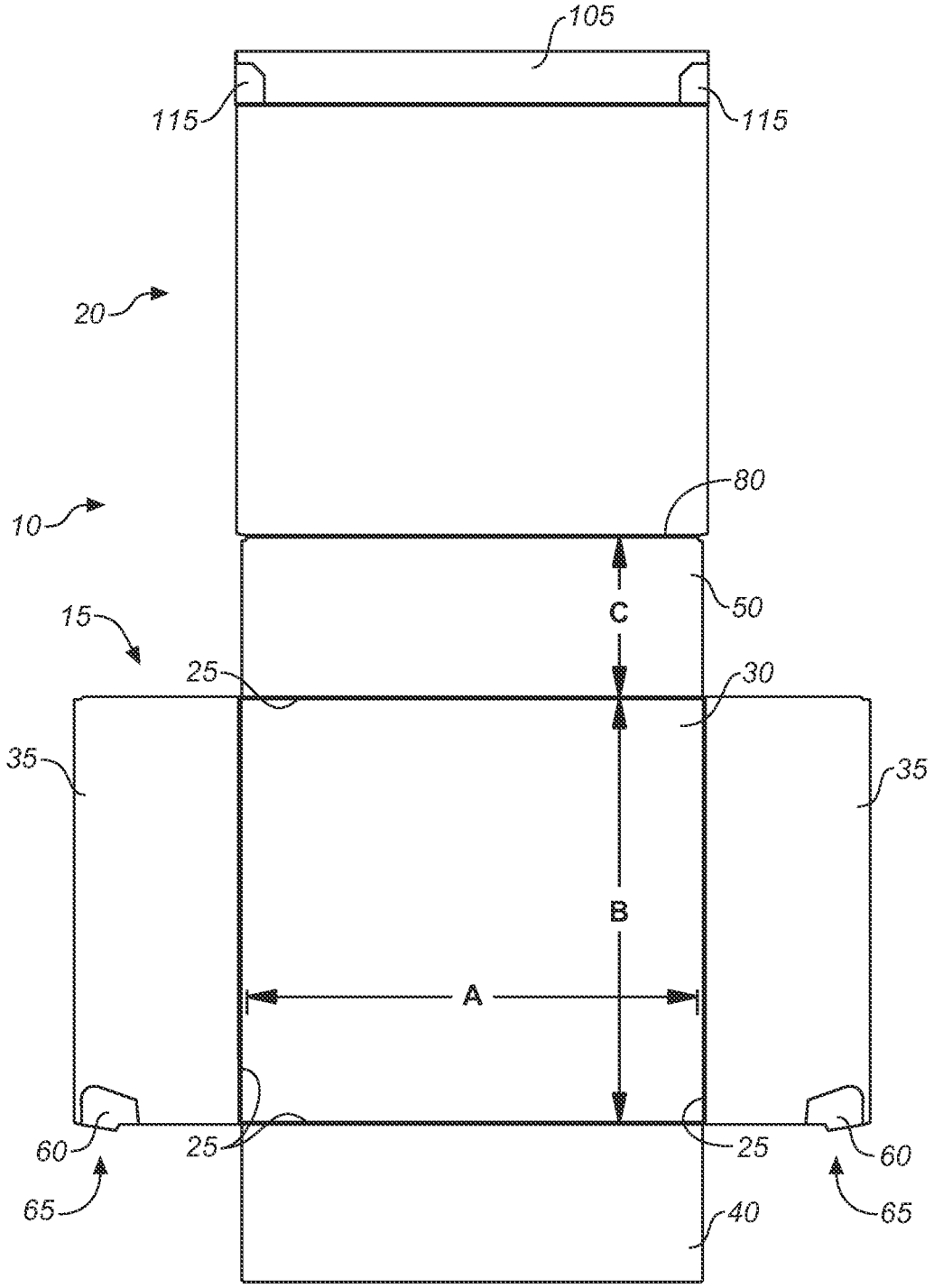
Figure 1C:
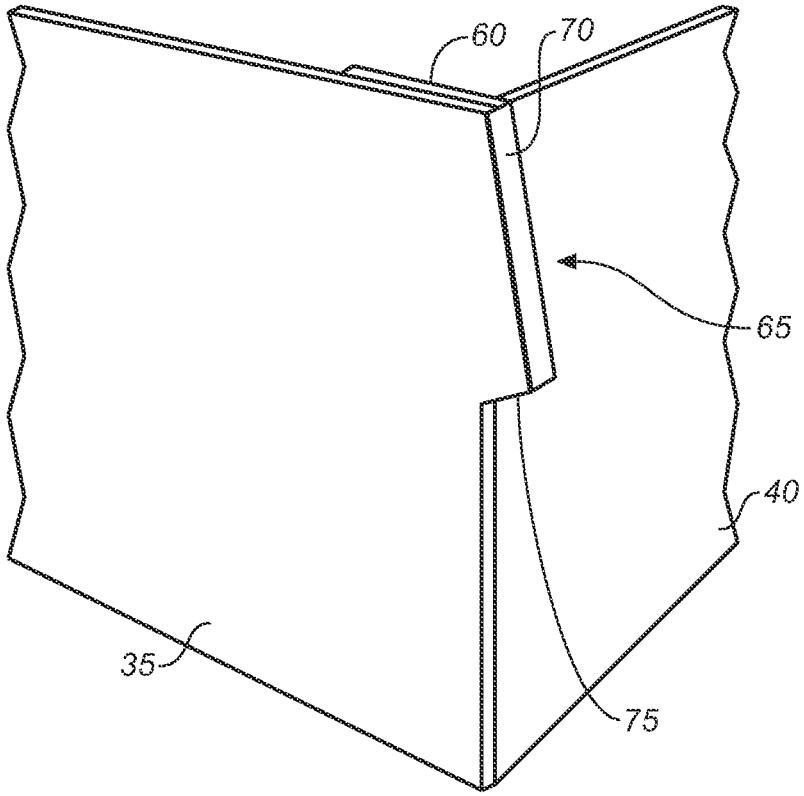

Tray section 15 also comprises fold lines 55 defining latching tabs 60. As best seen in FIG. 1B and FIG. 1C, latching tabs 60 may be folded about 180 degrees around fold lines 55 to lie flat against tray side panels 35, providing double sheet thickness latching protrusions 65 extending outward from the tray wall (e.g., away from the tray back wall). As depicted in FIG. 1C, latching protrusions 65 may each have, for example, an edge 70 sloping downward and away from the tray front wall and an edge 75 returning toward the tray front wall. As further described below, latching protrusions 65 may engage recesses in a lid portion of the clamshell box to latch the lid portion to the tray portion.

Referring again to FIG. 1A, lid section 20 comprises fold lines 80 and 85 defining a lid top panel 90 (optionally having dimensions matching those of the tray bottom panel) and folding lines 95 defining lid front panel 100 and lid front roll-over panel 105. Lid front roll-over panel 105 comprises notches 110 in its outer corners. Lid front roll-over panel 105 may be folded by about 180 degrees around fold lines 95 to lie flat against lid front panel 100. Lid front panel 100 and lid front roll-over panel 105 may then be folded by about 90 degrees around fold line 85 and secured in position to form a double sheet thickness lid front wall of a lid portion of the clamshell box. Panels 100 and 105 forming the lid front wall may be secured in the 90 degree position, for example, with tape, adhesive, or any suitable fastener. Alternatively, or in addition, panels 100 and 105 may be secured in position using folding and tab and slot methods as described below (FIGS. 2 and 3A-3L), for example, in which case sheet 10 may comprise additional panels and features.

Referring again to FIG. 1B, after panels 100 and 105 are folded as described above, the resulting double sheet thickness lid front wall comprises inner recesses 115 formed by notches 110 in panel 105.

Fold line 80 between tray back panel 50 and lid top panel 90 is oriented to act as a clamshell hinge around which the folded lid portion may be rotated to close the clamshell box, with protrusions 65 in the tray front wall of the folded tray portion engaging inner recesses 115 on the inside of the lid front wall of the lid portion to latch the lid portion to the tray portion.

Such sheets of material may be stored or shipped either in a flat configuration or in the folded configuration (i.e., in the form of the self-latching clamshell box), as convenient.

Figure 2:
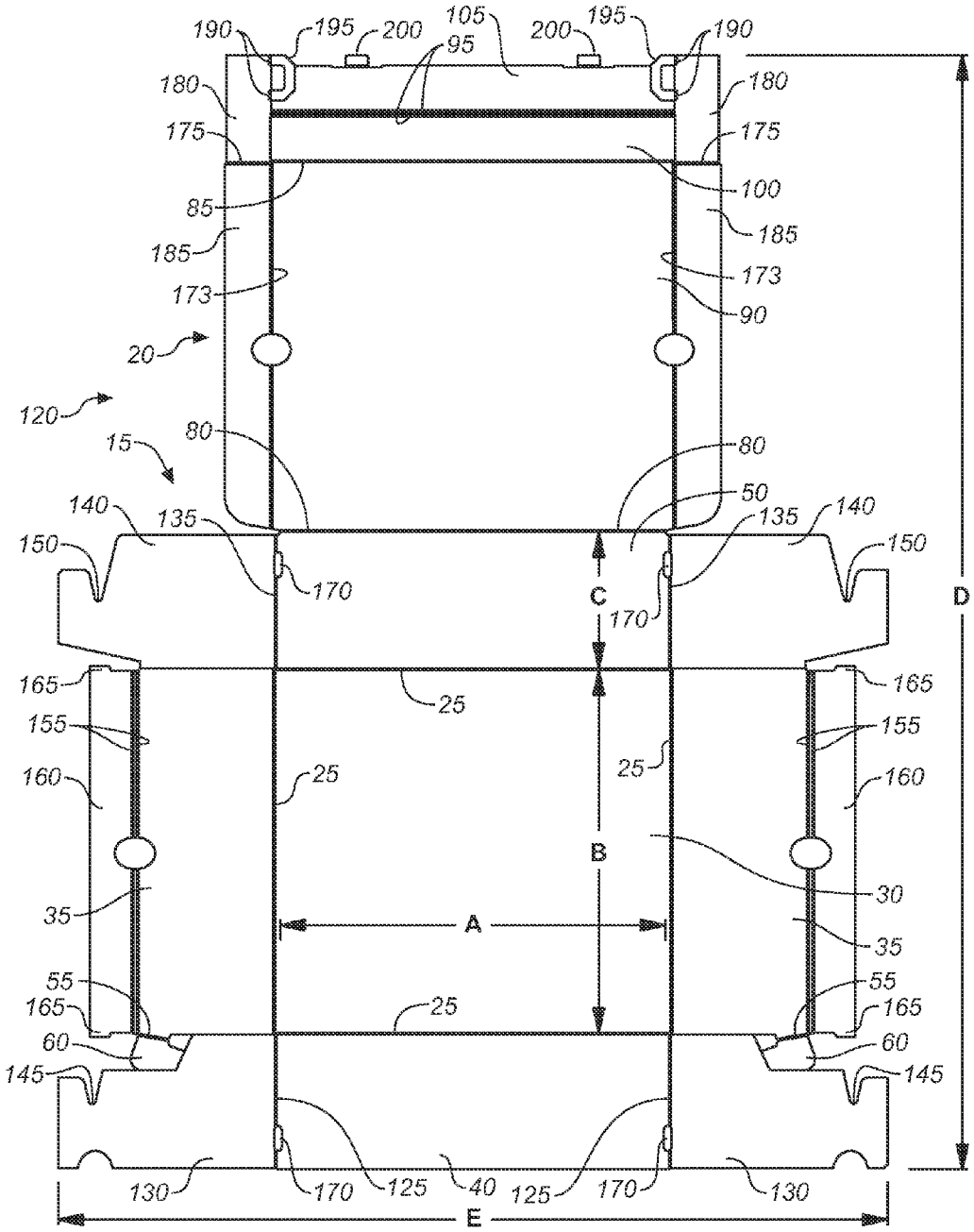
FIG. 2 shows a schematic drawing of another example sheet of material configured for folding into a self-latching clamshell box.

Referring now to FIG. 2, example sheet of material 120 is also configured to be folded into a self-latching clamshell box. In addition to the features of sheet 10 shown in FIGS. 1A-1C, sheet 120 includes additional features described below with reference to FIG. 2 and to FIGS. 3A-3L.

FIGS. 3A-3L show steps in an example method for folding sheet 120 of FIG. 2 into a self-latching clamshell box. The tray portion may be folded up as follows. First (FIG. 3A), tray front handshake side panels 130 are folded about 90 degrees around fold lines 125, and tray back handshake side panels 140 are similarly folded about 90 degrees around fold lines 135. Next (FIG. 3B) tray front panel 40 is folded about 90 degrees around the respective fold line 25 to form a tray front wall, tray back panel 50 is folded about 90 degrees around the respective fold line 25 to form a tray back wall, and notches 145 in tray front handshake side panels 130 are engaged with notches 150 in corresponding tray back handshake side panels 140 to secure front handshake side panels 130 to corresponding tray back handshake side panels 140. In the illustrated variation, tray front handshake side panels 130 tuck to the outside of tray back handshake side panels 140, but this is optional. Next (FIGS. 3B, 3C, 3E), latching tabs 60 are folded about 180 degrees to lie flat against the inside surface of side panels 35. Next (FIGS. 3B, 3C, 3E), side panels 35 are folded about 90 degrees around respective fold lines 25 to form the tray side walls. Next (FIGS. 3C-3F), roll-over side panels 160 are folded about 180 degrees around fold lines 155 to lie flat against the inside of the interengaged handshake panels 130 and 140, with the handshake panels sandwiched between roll-over side panels 160 and side panels 35. Next (FIGS. 3D, 3F), roll-over side panel tabs 165 are inserted into corresponding slots 170 in tray front panel 40 and tray back panel 50 to secure the tray side walls to the tray front and back walls.

Figure 3A:
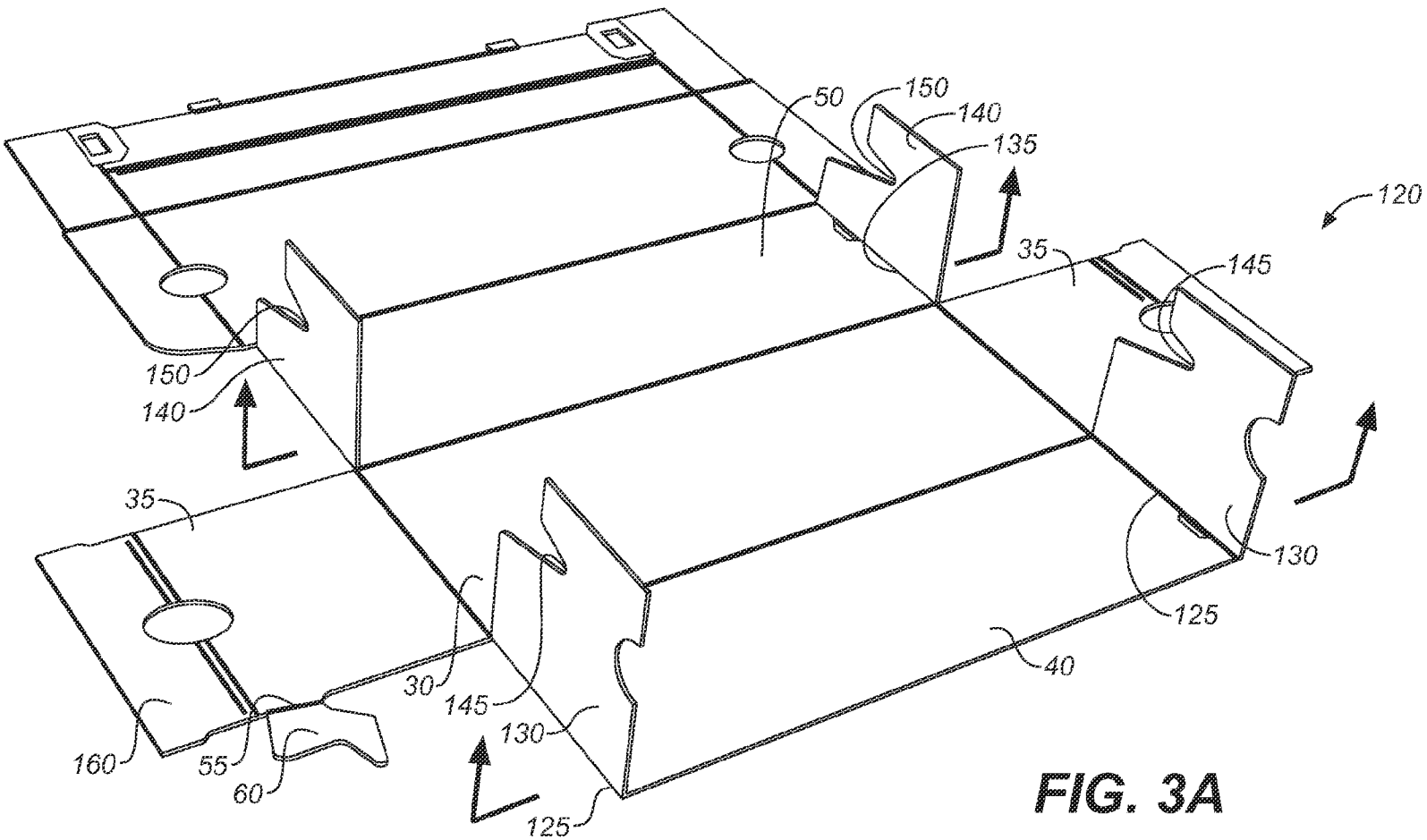
FIGS. 3A-3L show perspective views depicting steps in an example method of folding the sheet of material of FIG. 2 into a self-latching clamshell box.
Figure 3B:
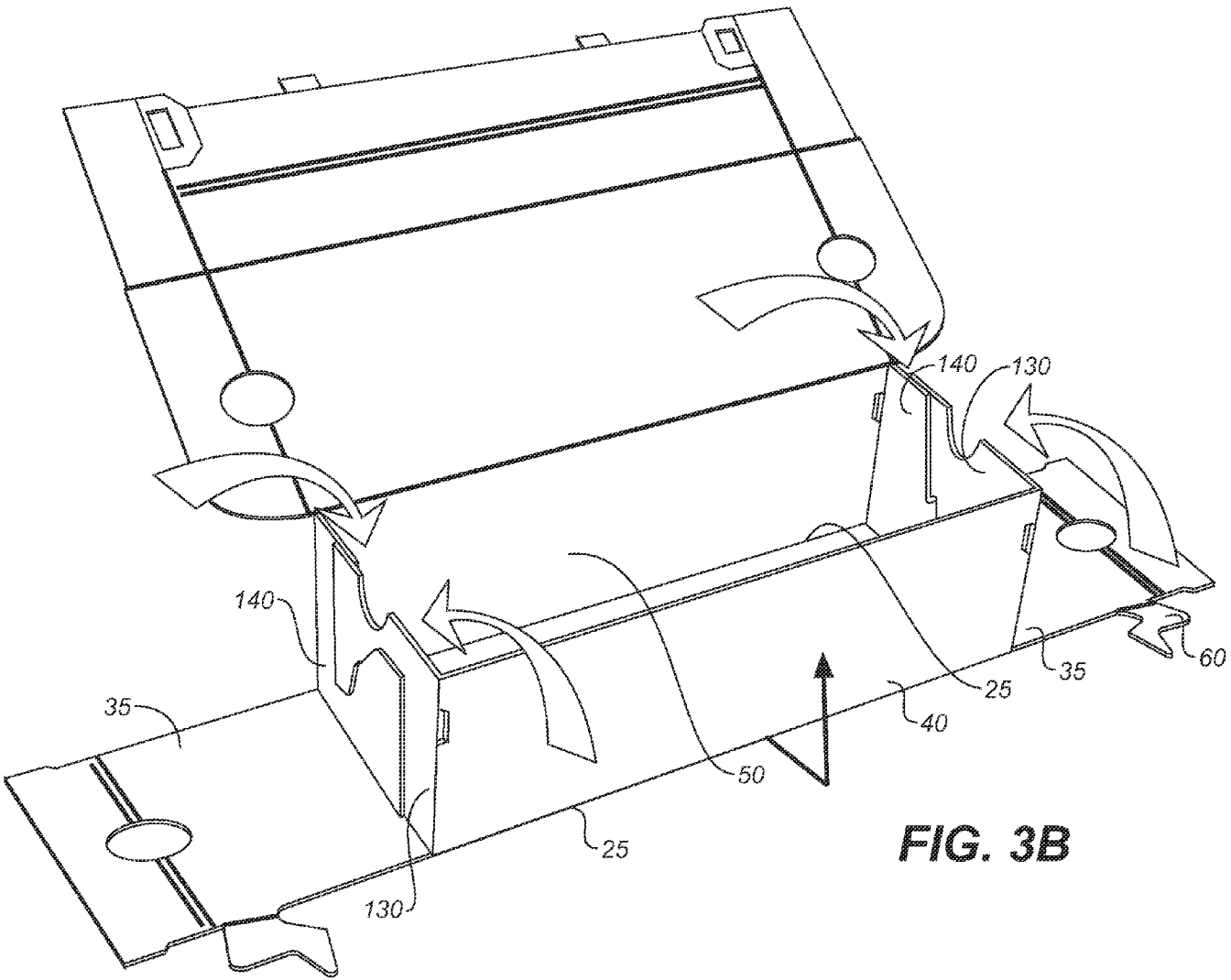
Figure 3C:
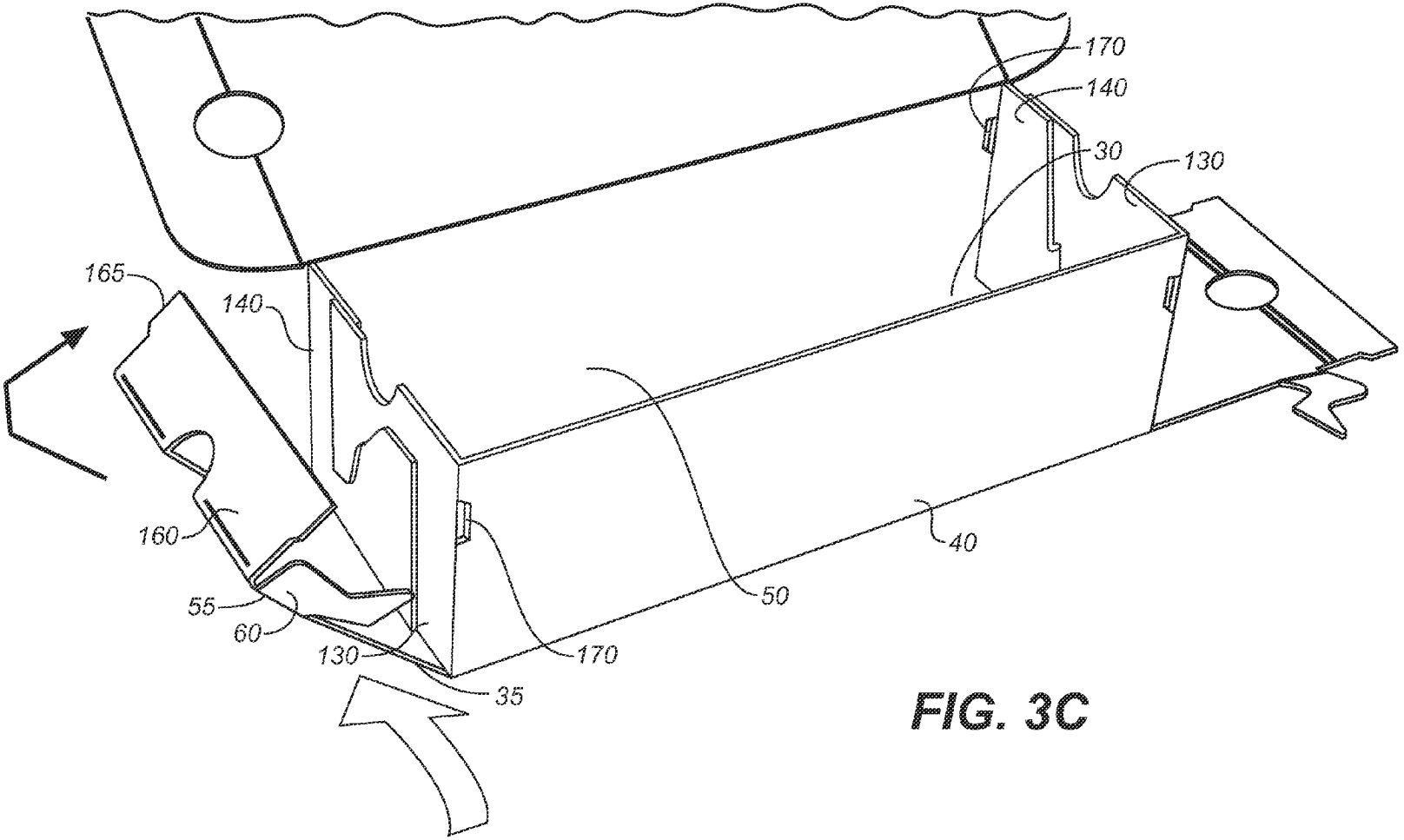
Figure 3D:
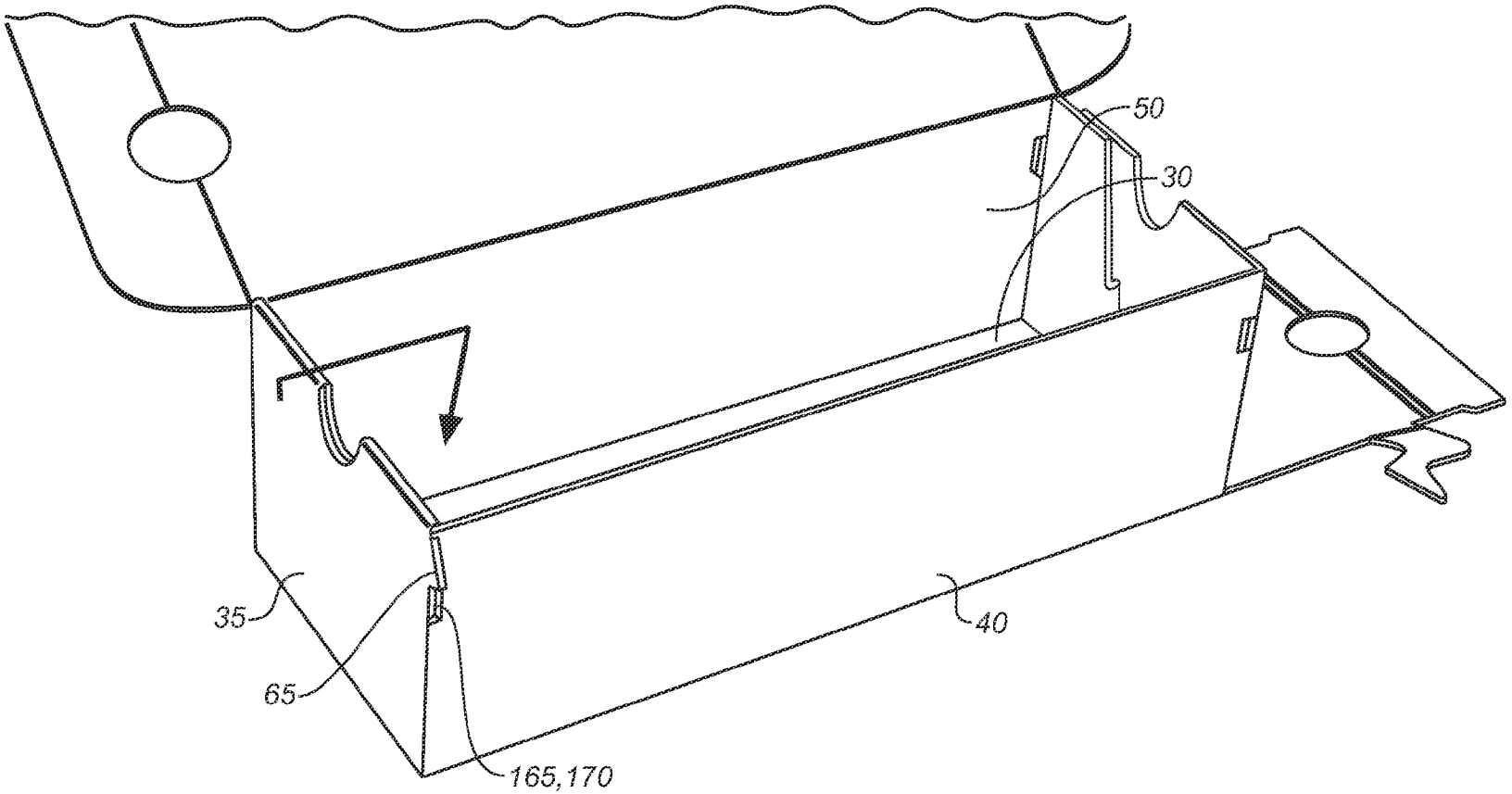
Figure 3E:
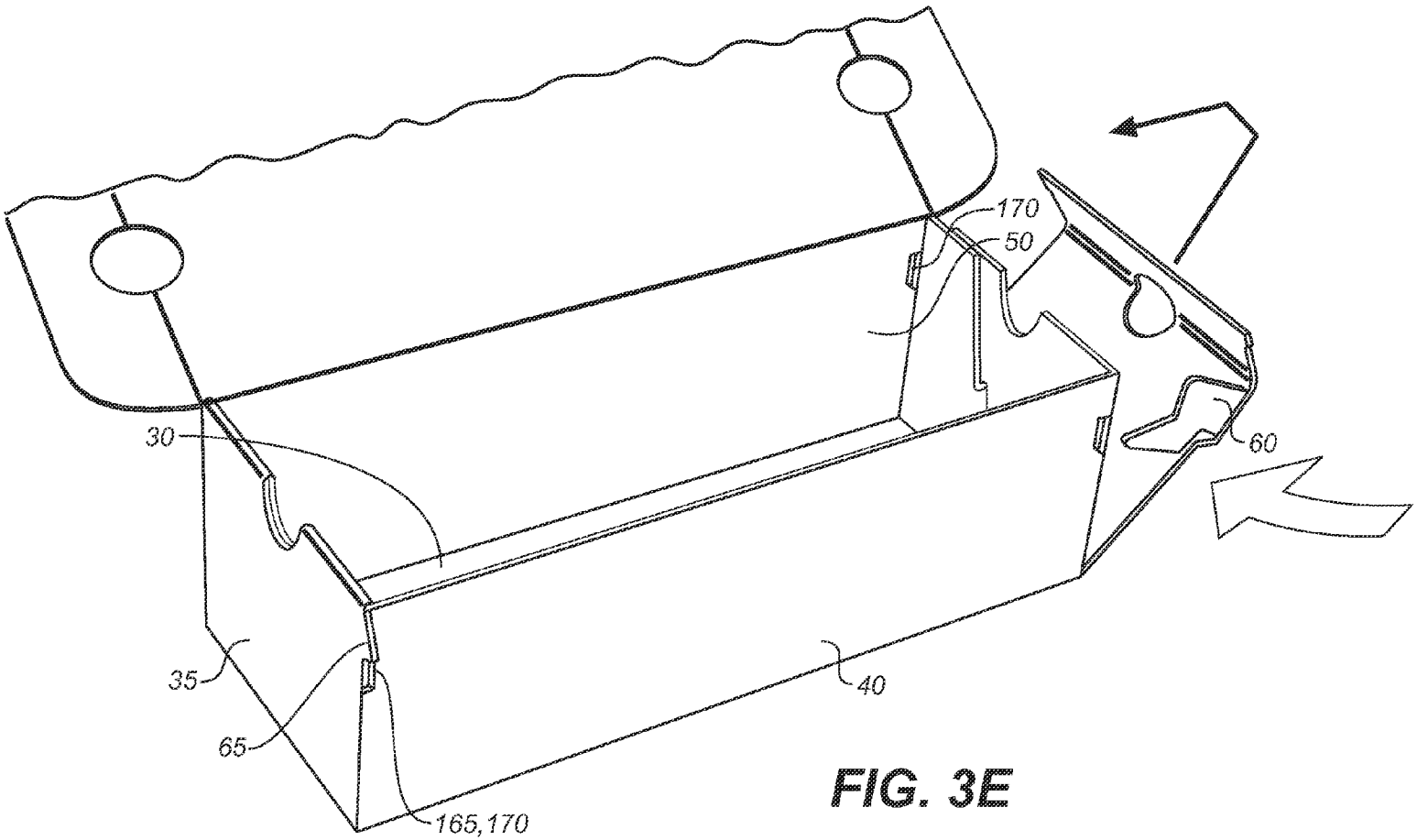
Figure 3F:
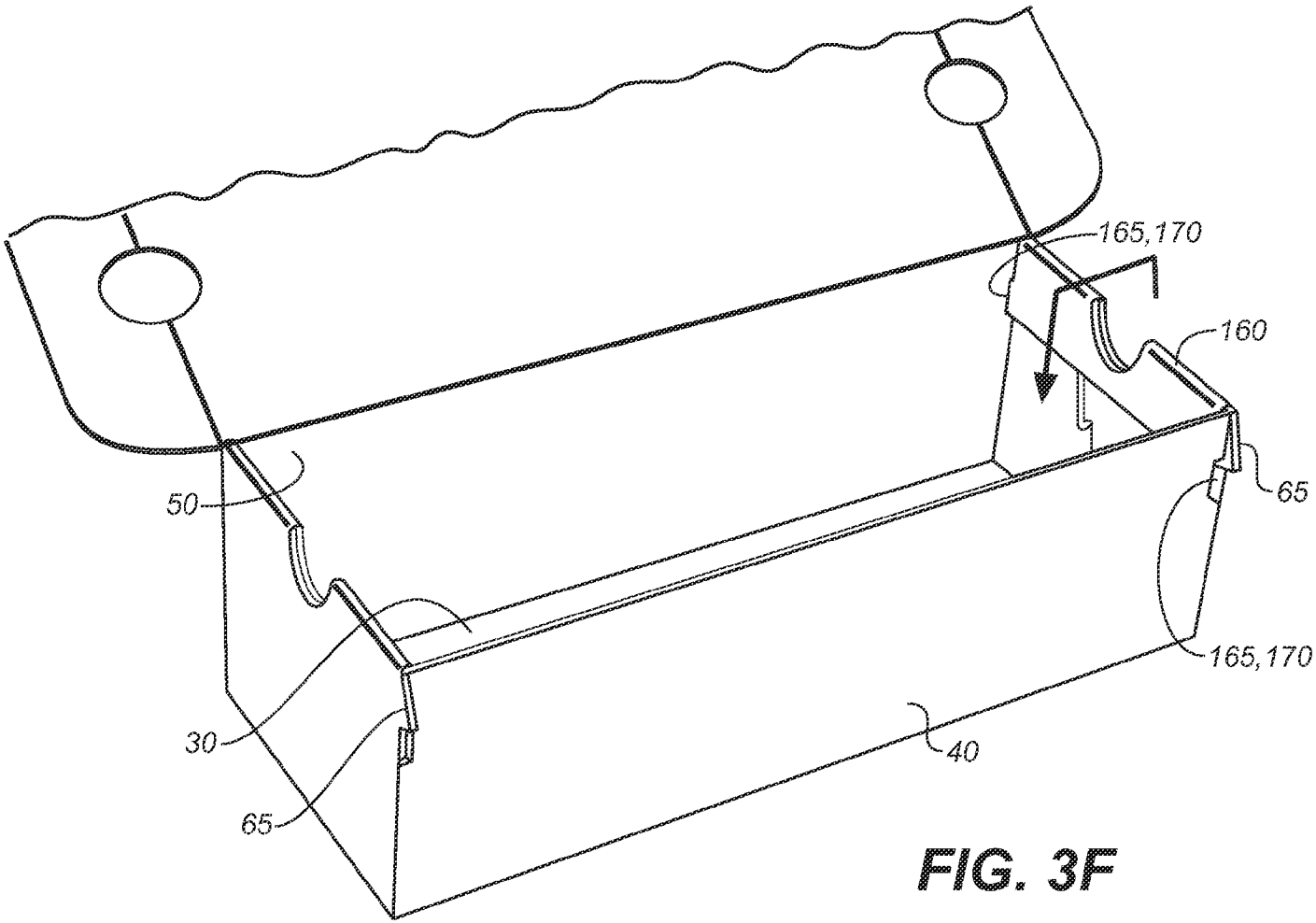
Figure 3G:
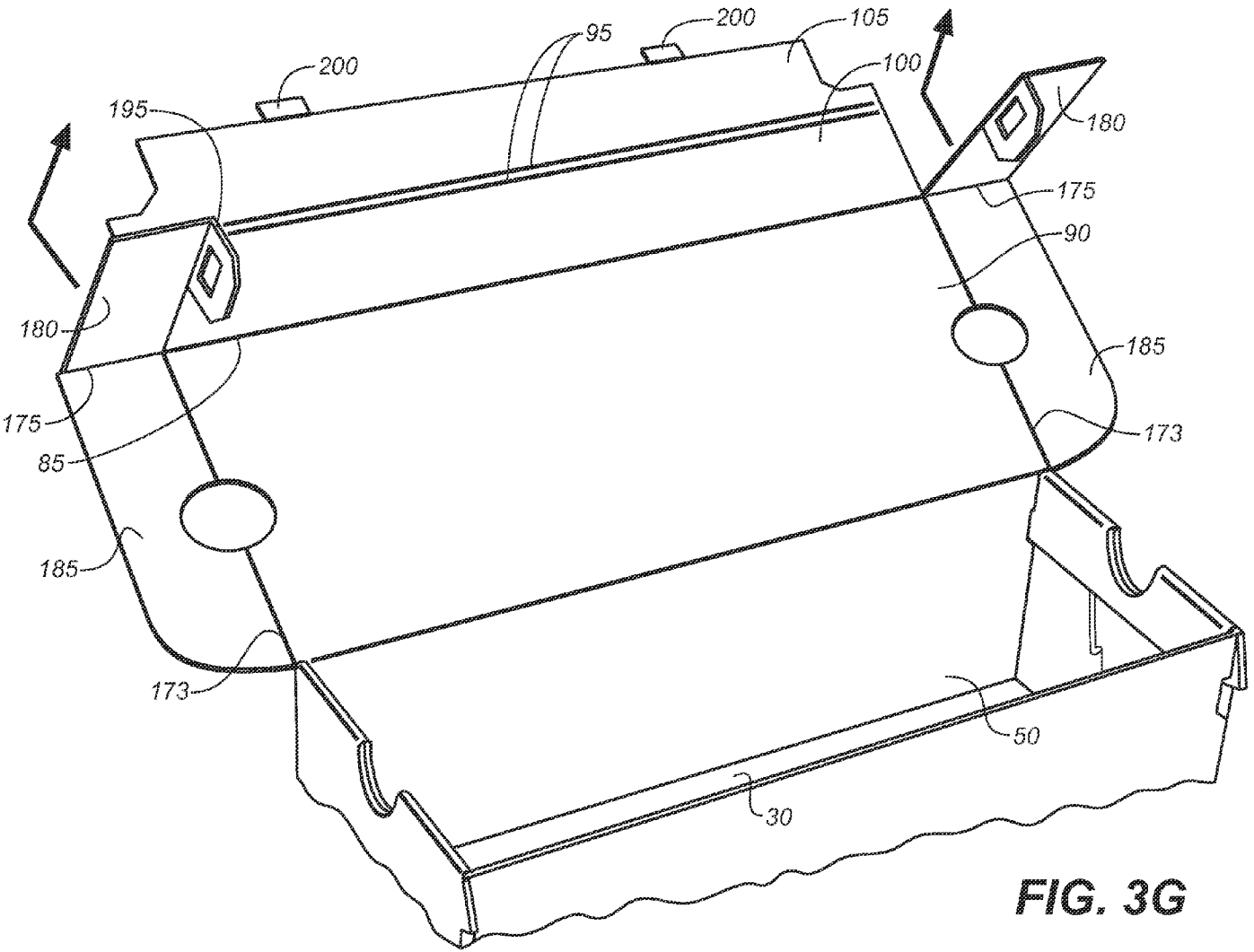
Figure 3H:
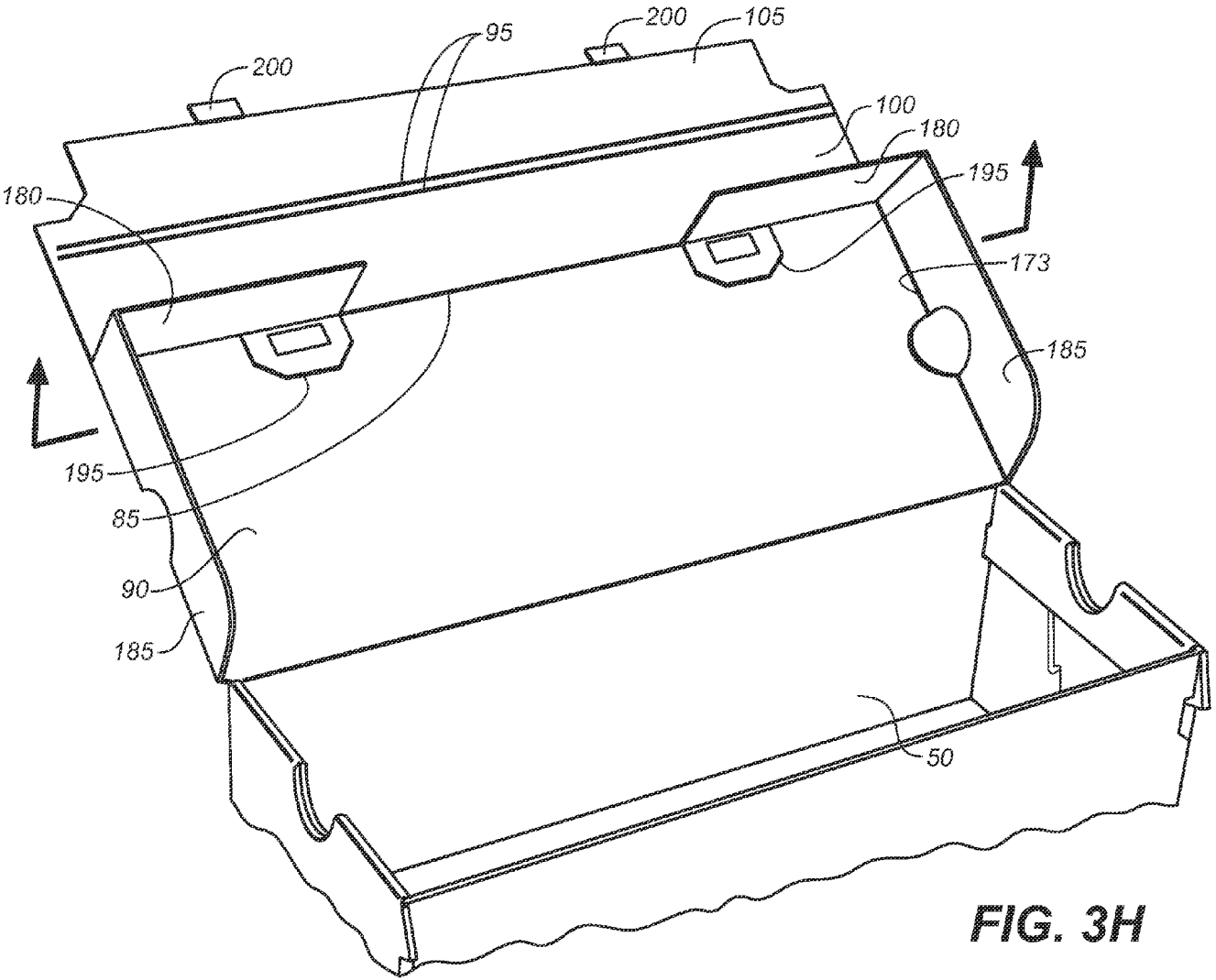
Figure 3I:
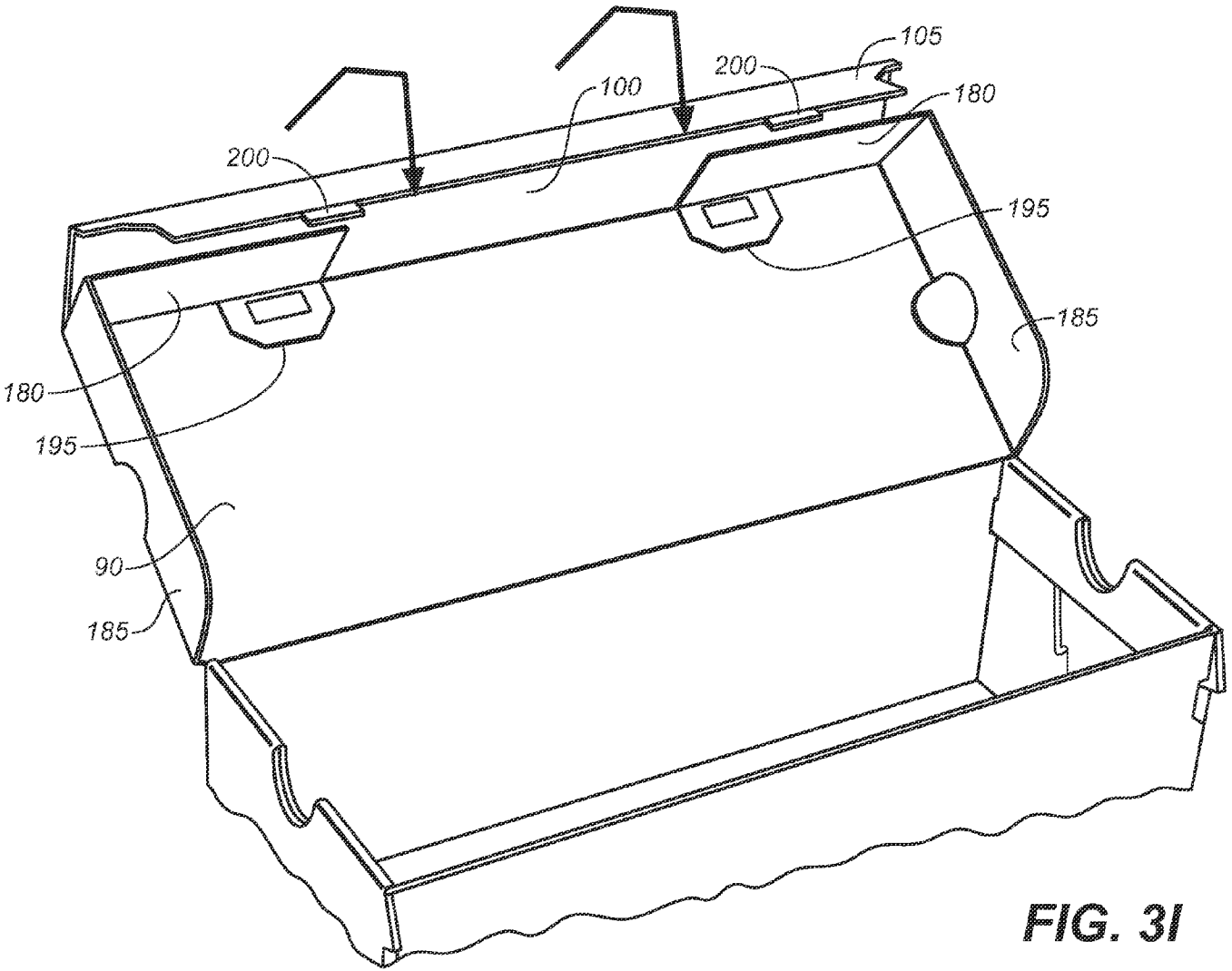
Figure 3J:
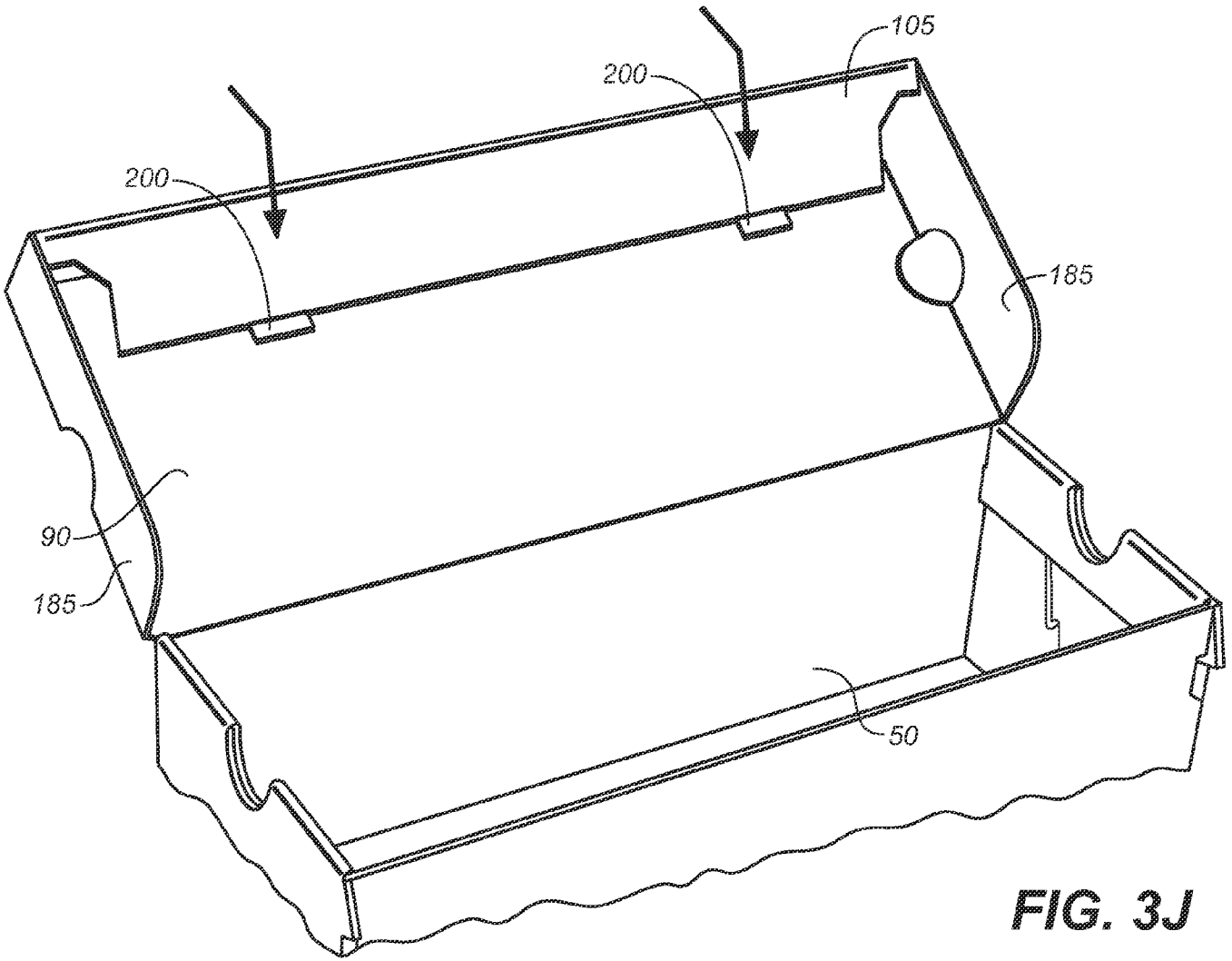
Figure 3K:
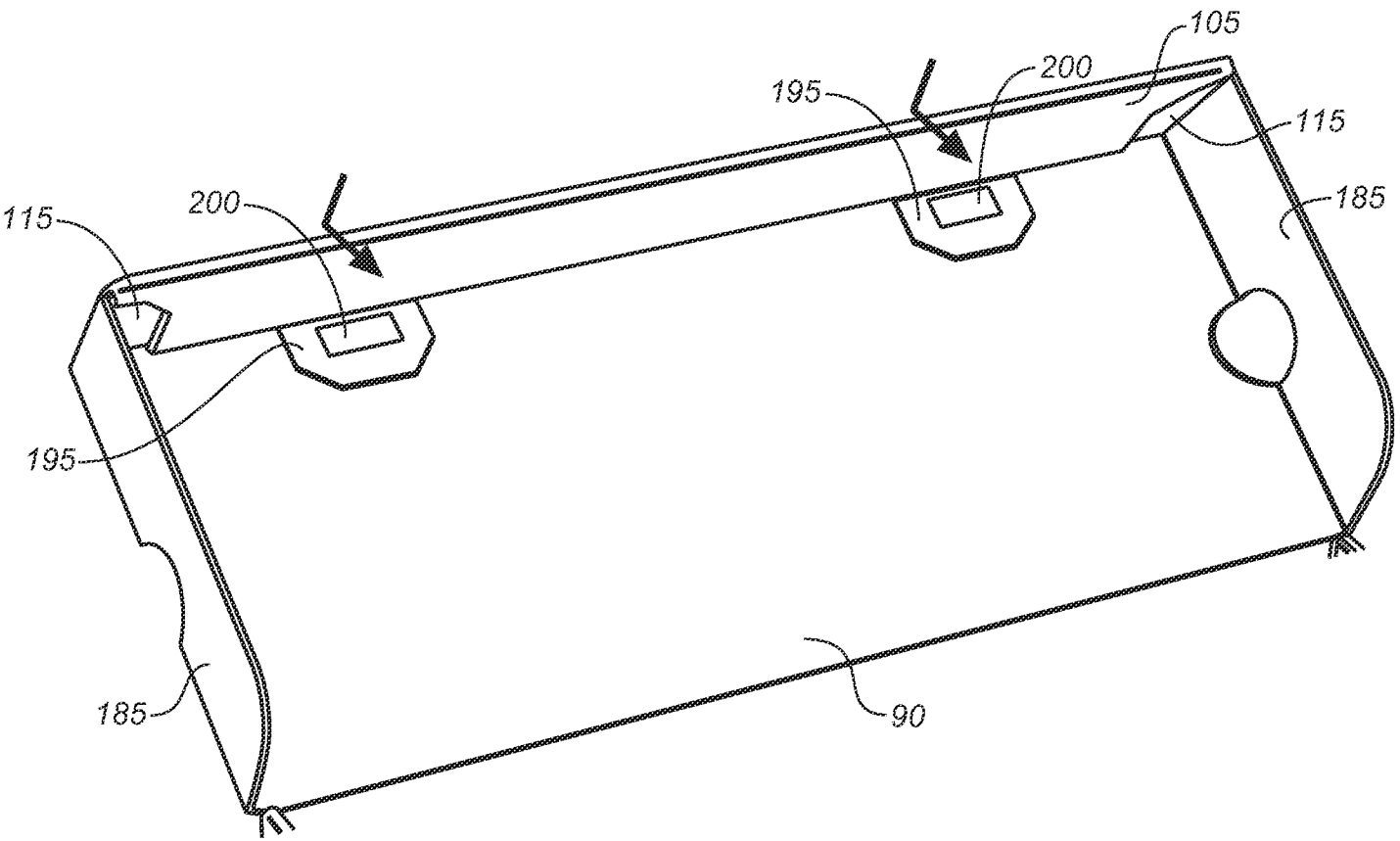
Figure 3L:
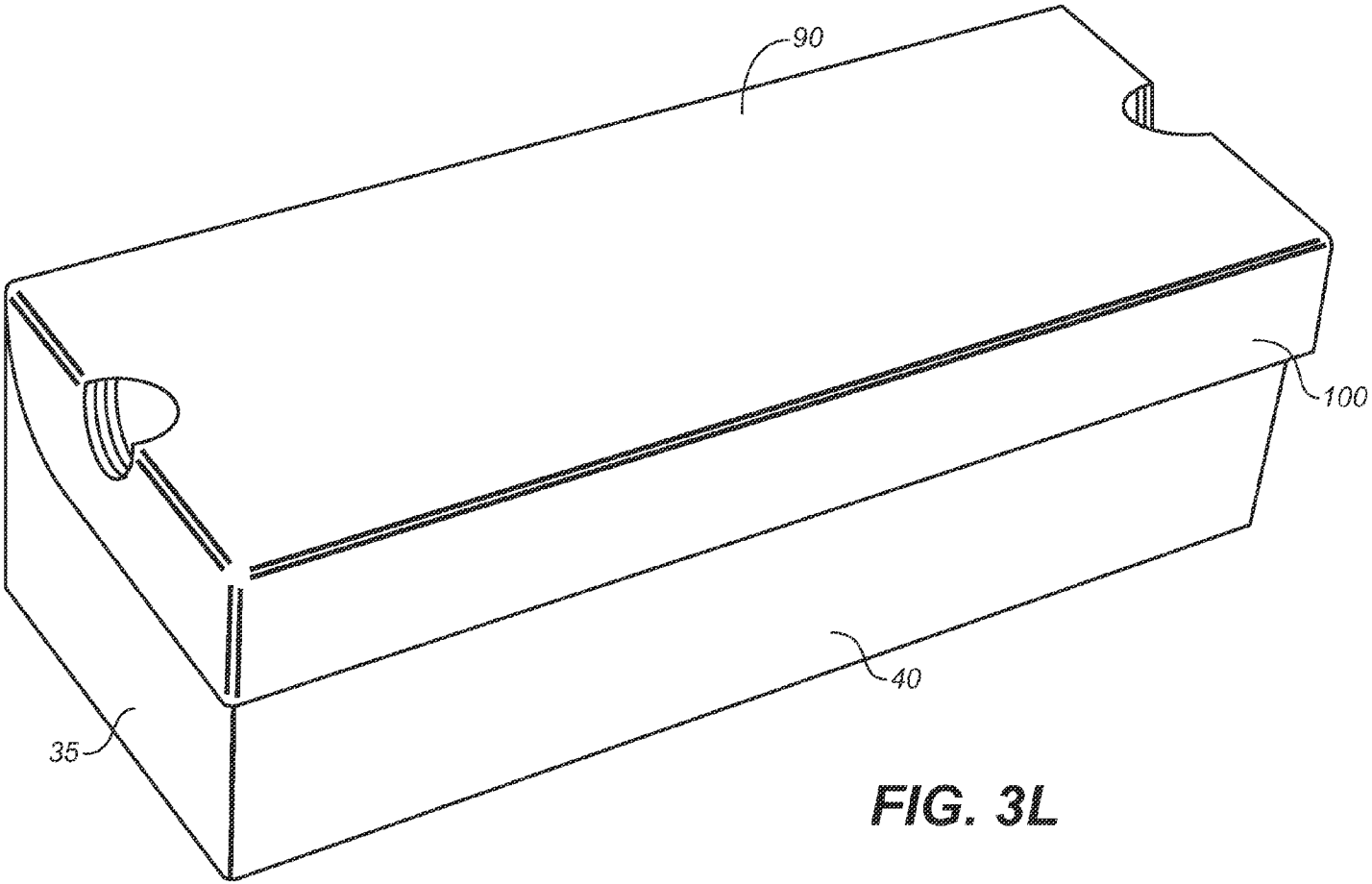

The lid portion may be folded up as follows. First (FIG. 3G), lid corner locking flanges 195 are folded about 90 degrees with respect to lid corner panels 180 around fold lines 190. Next (FIG. 3G), lid corner panels 180 are folded about 90 degrees with respect to lid side panels 185 around fold lines 175. Next (FIG. 3H), lid side panels 185 are folded about 90 degrees around fold lines 173 to form lid side walls and to form (in combination with lid corner panels 180) front corners of the lid portion of the clamshell box. Lid corner locking flanges 195 are then flush with lid top panel 90. Next (FIG. 3I), lid front panel 100 and lid front roll-over panel 105 are folded by about 90 degrees around fold line 85 to form a lid front wall. Next (FIGS. 3I-3K), roll-over lid panel 105 is folded about 180 degrees around fold lines 95 to lie flat against the inside of lid corner panels 180, which are sandwiched between roll-over lid panel 105 and lid front panel 100. Next (FIGS. 3I-3K), roll-over lid panel locking tabs 200 are inserted into lid corner locking flanges 195 to secure the lid front wall in position with respect to the lid top and side walls. The lid portion may then be rotated about the clamshell hinge provided by fold line 80 to engage recesses 115 with protrusions 65 to latch the lid portion to the tray portion of the self-latching clamshell box (FIG. 3L).

Referring again to FIGS. 1A, 1B, and 2, reference numerals A-E depicted in these figures identify the following dimensions: A—tray bottom width parallel to the clamshell hinge, B—tray bottom width perpendicular to the clamshell hinge, C—tray bottom depth, D—length of the blank (sheet of FIG. 2), and E—width of the blank (sheet of FIG. 2). In one variation, A is about 143 millimeters (mm), B is about 123 mm, C is about 63 mm, D is about 458 mm, and E is about 366 mm. In another variation, A is about 329 mm, B is about 126 mm, C is about 106 mm, D is about 569 mm, and E is about 638 mm. In another variation, A is about 347 mm, B is about 327 mm, C is about 123 mm, D is about 10005 mm, and E is about 747 mm.

More generally, A may be for example about 143 mm to about 405 mm, B may be for example about 91 mm to about 327 mm, C may be for example about 63 mm to about 143 mm, D may be for example about 458 mm to about 1005 mm, and E may be for example about 366 mm to about 788 mm.

The material used for the foldable sheets described herein may be or comprise, for example, corrugated fiberboard comprising a fluted corrugated sheet (e.g., E flute) sandwiched between liner boards, corrugated plastic board comprising a fluted corrugated sheet sandwiched between liner boards, or any other suitable corrugated or uncorrugated material (e.g., uncorrugated paperboard). Where the sheet comprises corrugated material, the flutes may be preferably aligned perpendicularly to the clamshell hinge.

This disclosure is illustrative and not limiting. Further modifications will be apparent to one skilled in the art in light of this disclosure and are intended to fall within the scope of the appended claims. For example, where methods and steps described above indicate certain events occurring in certain order, those of ordinary skill in the art will recognize that the ordering of certain steps may be modified and that such modifications are in accordance with the inventions disclosed herein. Additionally, certain of the steps may be performed concurrently in a parallel process when possible, as well as performed sequentially as described above. Acts referred to herein as operations in a method or process may also be understood as "steps" in the method or process. Therefore, to the extent there are variations of the inventions disclosed herein, which are within the spirit of this disclosure or equivalent to the inventions disclosed herein, it is the intent that this disclosure and the claims it supports will cover those variations as well.

What is claimed is:

1. A sheet of material configured to be folded into a self-latching clamshell box, the sheet of material comprising:

a tray section comprising fold lines defining a rectangular tray bottom panel, first and second tray side panels attached to and on opposite ends of the tray bottom panel, a tray front panel attached to a front end of the tray bottom panel, a tray back panel attached to a back end of the tray bottom panel opposite from the front end of the tray bottom panel, a first latching tab attached to an outer front corner of the first tray side panel, and a second latching tab attached to an outer front corner of the second tray side panel; and a lid section comprising fold lines defining a rectangular lid top panel with a back end of the lid top panel defined by a fold line between the lid top panel and the tray back panel, a lid front panel attached to the lid top panel opposite from the tray back panel, and a lid front roll-over panel attached to the lid front panel, the lid front roll-over panel comprising notches in two outer corners;

wherein:

the tray section fold lines are configured such that the first and second tray side panels, the tray front panel, and the tray back panel may each be folded about 90 degrees with respect to the tray bottom panel about respective fold lines to form, respectively, first and second tray side walls, a tray front wall, and a tray back wall of a tray portion of the clamshell box, and the first and second latching tabs may be folded about 180 degrees with respect to the first and second tray side panels, respectively, about respective fold lines to form first and second protrusions extending outward from the tray front wall at opposite ends of the tray front wall;

the lid section fold lines are configured such that the lid front roll-over panel may be folded about 180 degrees with respect to the lid front panel about a respective fold line, the lid front panel and the lid front roll-over panel may be folded about 90 degrees with respect to the lid top panel about a respective fold line to form a lid front wall of a lid portion of the clamshell box, the lid front wall comprising inner recesses formed by the notches in the lid front roll-over panel; and the fold line between the tray back panel and the lid top panel is configured to form a clamshell hinge about which the folded lid portion may be rotated to close the clamshell box, with the protrusions on the tray front wall of the folded tray portion engaging the inner recesses in the lid front wall of the lid portion to latch the lid portion to the tray portion.

2. The sheet of material of claim 1, comprising fold lines defining tray front handshake side panels attached to the ends of the tray front panel and fold lines defining tray back handshake side panels attached to the ends of the tray back panel, each tray front handshake side panel comprising a notch configured to engage a notch in a corresponding tray back handshake side panel when the tray section of the sheet is folded into a tray configuration.

3. The sheet of material of claim 2, comprising fold lines defining roll-over side panels attached to the ends of the tray side panels, each roll-over side panel configured to fold to sandwich an engaged pair of tray front handshake and tray back handshake side panels between the roll-over side panel and a corresponding tray side panel when the tray section of the sheet is folded into a tray configuration.

4. The sheet of material of claim 3, comprising tabs located at each end of each roll-over side panel, the tabs configured to engage corresponding slots in the tray front panel and tray back panel when the tray section of the sheet is folded into a tray configuration.

5. The sheet of material of claim 1, comprising fold lines defining lid side panels attached at opposite ends of the lid top panel and lid corner panels attached at the end of each lid side panel farthest away from the clamshell hinge, the lid side panels configured to form lid side walls and the lid corner panels configured to form, in combination with the lid side panels, front corners of the lid when the lid section of the sheet is folded into a lid configuration.

6. The sheet of material of claim 5, comprising fold lines defining a lid front panel attached to an end of the lid top panel farthest away from the clamshell hinge and a lid roll-over panel attached to the lid front panel, the lid front panel and the lid roll-over panel configured to fold to sandwich the lid corner panels and to form a lid front wall when the lid section of the sheet is folded into a lid configuration.

7. The sheet of material of claim 6, comprising lid corner locking flanges attached to the lid corner panels and configured to lie flat against the lid top panel when the lid section is folded into a lid configuration, and lid roll-over panel tabs attached to an outer edge of the lid roll-over panel and configured to engage slots in the lid corner locking flanges when the lid section is folded into a lid configuration.

8. The sheet of material of claim 3, comprising fold lines defining lid side panels attached at opposite ends of the lid top panel and lid corner panels attached at the end of each lid side panel farthest away from the clamshell hinge, the lid side panels configured to form lid side walls and the lid corner panels configured to form, in combination with the lid side panels, front corners of the lid when the lid section of the sheet is folded into a lid configuration.

9. The sheet of material of claim 8, comprising fold lines defining a lid front panel attached to an end of the lid top panel farthest away from the clamshell hinge and a lid roll-over panel attached to the lid front panel, the lid front panel and the lid roll-over panel configured to fold to sandwich the lid corner panels and to form a lid front wall when the lid section of the sheet is folded into a lid configuration.

10. The sheet of material of claim 9, comprising tabs located at each end of each roll-over side panel, the tabs configured to engage corresponding slots in the tray front panel and tray back panel when the tray section of the sheet is folded into a tray configuration.

11. The sheet of material of claim 10, comprising lid corner locking flanges attached to the lid corner panels and configured to lie flat against the lid top panel when the lid section is folded into a lid configuration, and lid roll-over panel tabs attached to an outer edge of the lid roll-over panel and configured to engage slots in the lid corner locking flanges when the lid section is folded into a lid configuration.

12. The sheet of material of claim 1, wherein the sheet material is or comprises corrugated board.

13. The sheet of material of claim 1, wherein the sheet of material is in a flat or substantially flat configuration.

14. The sheet of material of claim 1, wherein the sheet of material is folded into a clamshell box configuration.

* * * * *